US006039786A

United States Patent [19]

Marles Franco

[11] Patent Number: 6,039,786

[45] Date of Patent: Mar. 21, 2000

[54] PROCESS FOR MELTING A METAL CHARGE IN A ROTARY FURNACE AND ROTARY FURNACE FOR IMPLEMENTING SUCH A PROCESS

[75] Inventor: Joan Marles Franco, Barcelona, Spain

[73] Assignee: L'Air Liquide, Societe Anonyme pour l'Etude et l'Exploitation de Procedes Georges Claude, Paris, France

[21] Appl. No.: 08/750,559

[22] PCT Filed: Jun. 15, 1995

[86] PCT No.: PCT/FR95/00791

§ 371 Date: May 22, 1997

§ 102(e) Date: May 22, 1997

[87] PCT Pub. No.: WO95/34791

PCT Pub. Date: Dec. 21, 1995

[30] Foreign Application Priority Data

Jun. 16, 1994 [ES] Spain ..... 9401366

[51] Int. Cl.[7] ..... C21C 1/08; F27B 7/20

[52] U.S. Cl. ..... 75/414; 75/571; 266/213; 266/248; 266/900

[58] Field of Search ..... 75/476, 571, 581, 75/414; 266/213, 248, 900, 901

[56] References Cited

U.S. PATENT DOCUMENTS

| | | | |
|---|---|---|---|
| 3,436,066 | 4/1969 | Bouchet | 75/476 |
| 4,414,026 | 11/1983 | Fukushima et al. . | |
| 5,123,364 | 6/1992 | Gitman et al. | 110/346 |
| 5,163,997 | 11/1992 | Sherwood | 266/213 |
| 5,714,113 | 2/1998 | Gitman et al. | 266/182 |

FOREIGN PATENT DOCUMENTS

| | | |
|---|---|---|
| 553632 | 8/1993 | European Pat. Off. . |
| 92 09942 | 2/1994 | France . |
| 41 42 401 | 6/1993 | Germany . |

*Primary Examiner*—Melvyn Andrews
*Attorney, Agent, or Firm*—Burns, Doane, Swecker & Mathis, LLP

[57] ABSTRACT

Process for melting a metal charge in a rotary furnace equipped with at least one oxygen burner, comprising the steps of:

(i) adding between 1.5 and 9% of a charge of solid fuel to the metal charge to form a combined charge; and (ii) injecting at least one jet of oxygen in a direction of the combined charge in the furnace.

17 Claims, 8 Drawing Sheets

PROCESS FOR MELTING A METAL CHARGE IN A ROTARY FURNACE AND ROTARY FURNACE FOR IMPLEMENTING SUCH A PROCESS

BACKGROUND OF THE INVENTION (i) Field of the Invention

The present invention relates to processes for melting metal charges in a rotary furnace equipped with at least one oxygen burner.

(ii) Description of Related Art

In known processes the oxygen burner, controlled in stoichiometric conditions, ensures the melting of the metal charge containing, optionally and for purely metallurgical reasons, small quantities of solid fuels, generally not exceeding 1% of the metal charge, in order to limit the formation of undesirable unburnt volatile compounds which, also where the oxygen burner is sued, limit the conditions in which the combustion is performed and, consequently, the rate of melting of the charge in the furnace.

A process for melting solid materials using an air or oxycombustible burner well under stoichiometric is known in DE-A-4142301, in which process oxygen is added in the oven with the aid of nozzles.

SUMMARY AND OBJECTS OF THE INVENTION

The objective of the present invention is to create an improved process enabling the rate and efficiency of melting in a given furnace to be significantly increased, while reducing the overall energy consumption.

To do this, according to one characteristic of the invention, the process includes the stages of adding a charge of solid fuel included between 1.5 and 9% to the metal charge to be melted and of injecting at least one jet of oxygen in the direction of the combine charge in the furnace.

According to other characteristics of the invention:

- the proportion of charge of solid fuels in the metal charge is between 1.5 and 9%, advantageously between 2 and 6%;
- the oxygen is injected at a speed close to the speed of sound or supersonic;
- the oxygen jet is injected, as soon as the burner is brought into action, between the flame of the burner and the combined charge in the furnace.
- the oxygen is injected at a speed which is close to the speed of sound or supersonic;
- the jet of oxygen is injected, as soon as the burner is brought into action, between the flame of the burner and the combined charge in the furnace.

Another objective of the present invention is a rotary furnace for implementing such a process, including, besides an oxygen burner, at least one oxygen lance placed so as to direct at least one jet of oxygen towards the bottom of the furnace.

With the process according to the invention the combustion is extended into the charge itself, where the oxygen injected by the lance interacts with the solid fuel which burns in direct contact with the metal, thus extremely considerably increasing the reaction surface and thus promoting accelerated melting without affecting the temperature conditions at the furnace refractory and therefore not reducing the lifetime of the latter. Furthermore, since an appreciable proportion, exceeding 35%, of the total combustion energy is provided in the charge by the solid fuel, the power of the burner and hence its cost can be significantly reduced.

Other characteristics and advantages of the present invention will emerge from the following description of embodiments.

DETAILED DESCRIPTION OF THE PREFERRED EMBODIMENTS

Figure 1:
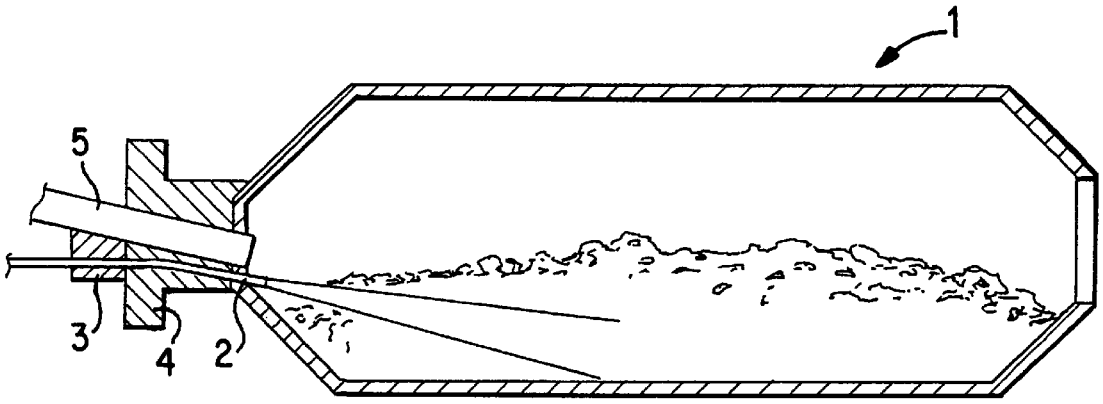
FIG. 1 is a diagrammatic view, in lengthwise section, of an embodiment of a furnace for melting metal according to the invention.
Figure 2:
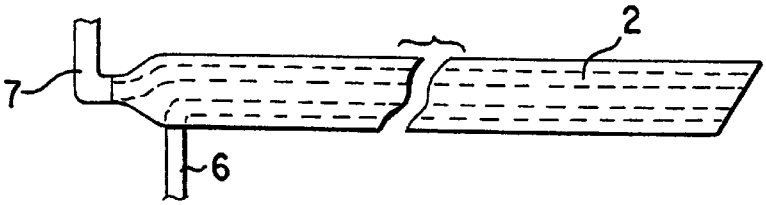
FIGS. 2 and 3 are, respectively, side and sectional views of an embodiment of a multitube oxygen lance.
Figure 3:
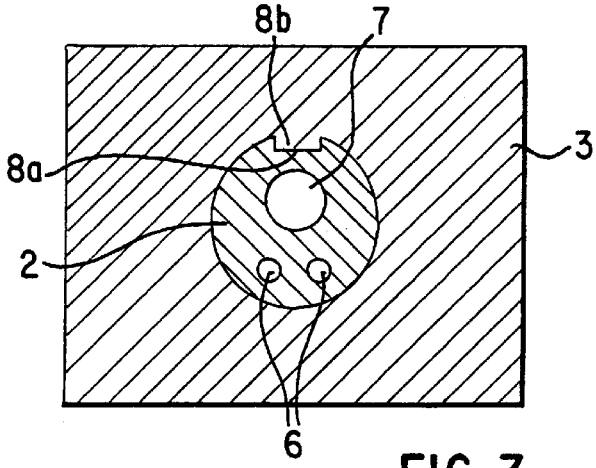

In FIG. 1 a rotary furnace 1 is shown, in the end door 4 of which are fitted an oxygen burner 5 pointing towards the charge and an oxygen lance 2 which can be positioned adjustably by virtue of a guiding device 3. According to the invention the lance 2 is pointed so as to direct, in the furnace 1, a high-speed, typically supersonic jet of oxygen towards a combined charge of metal, typically of steel, to be melted and of a solid fuel in proportions which are typically higher than 2% of the metal charge. This solid fuel is typically anthracite, graphite, especially electrode graphite, or other products containing carbon and hydrogen, especially solid polyolefins. Examples of operating conditions are given later in relation to Tables 1 to 3 and FIGS. 8 to 12. FIGS. 2 and 3 show a particular embodiment of an oxygen lance 2 including an upper main oxygen delivery 7 and two lower oxygen deliveries 6 enabling differentiated oxygen jets to be ejected in the direction of the charge and below the flame of the burner 5. The lance body 2 comprises a groove 8*a* interacting with a rib 8*b* of the guiding device 3 for maintaining a correct orientation of the tubes 6 and 7 when the lance 2 is being adjusted forward or backward in the furnace 1.

Figure 4:
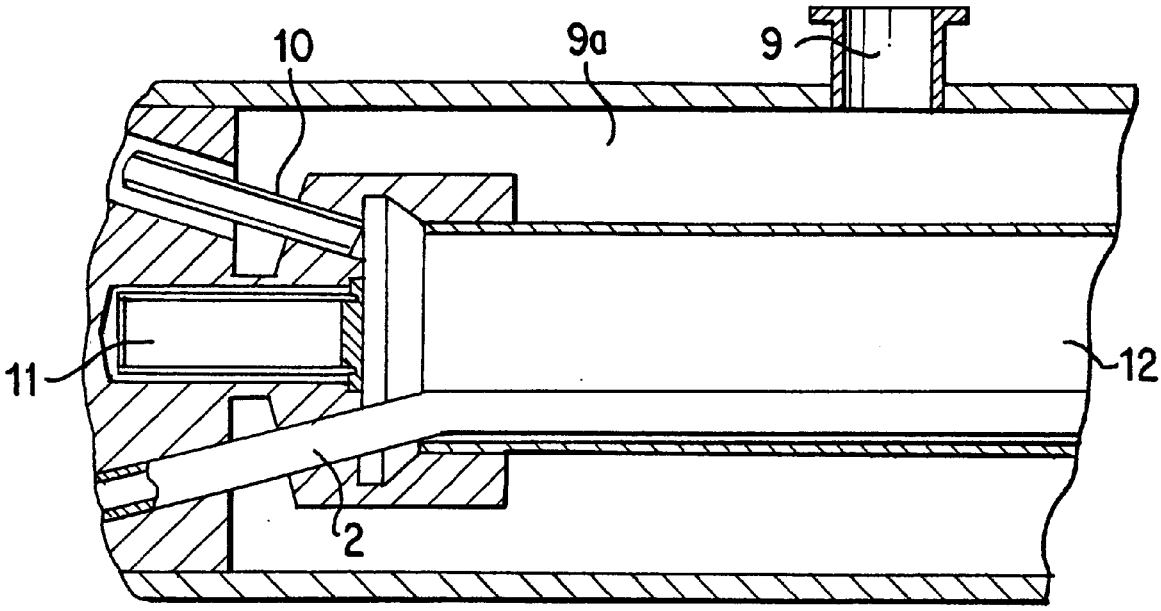
FIG. 4 is a partial view in lengthwise section of a burner with integrated lance according to the invention.
Figure 5:
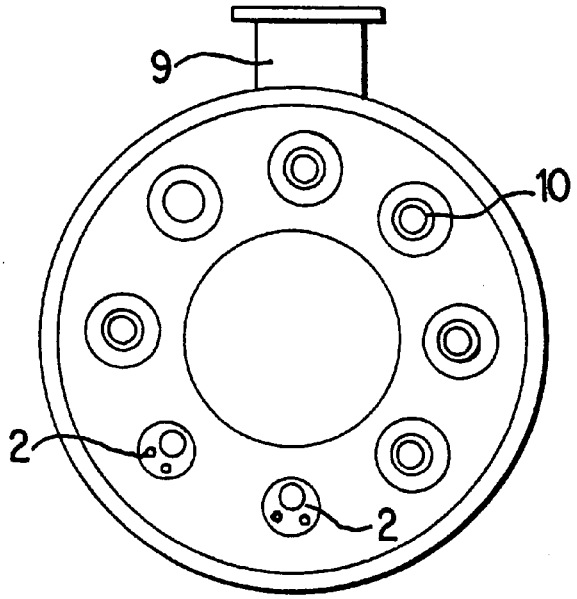
FIG. 5 is an end view of the burner of FIG. 4.

FIGS. 4 and 5 show an oxygen burner comprising a central delivery 12 of fuel gas into a shell forming a channel 9*a* for oxygen introduced via an entry 9, the fuel gas being ejected by the injectors 10 lying in the oxygen exit orifices in the nozzle of the burner, which are here angularly distributed around the axis of the burner. In the lower part of the latter the combined oxygen/gaseous fuel ejection orifices are replaced by at least one lance 2, as described in relation to FIGS. 2 and 3, and the upstream portion of which lies in the central fuel delivery 12. The end of a central circuit for cooling the nozzle of the burner is shown at 11.

Figure 6:
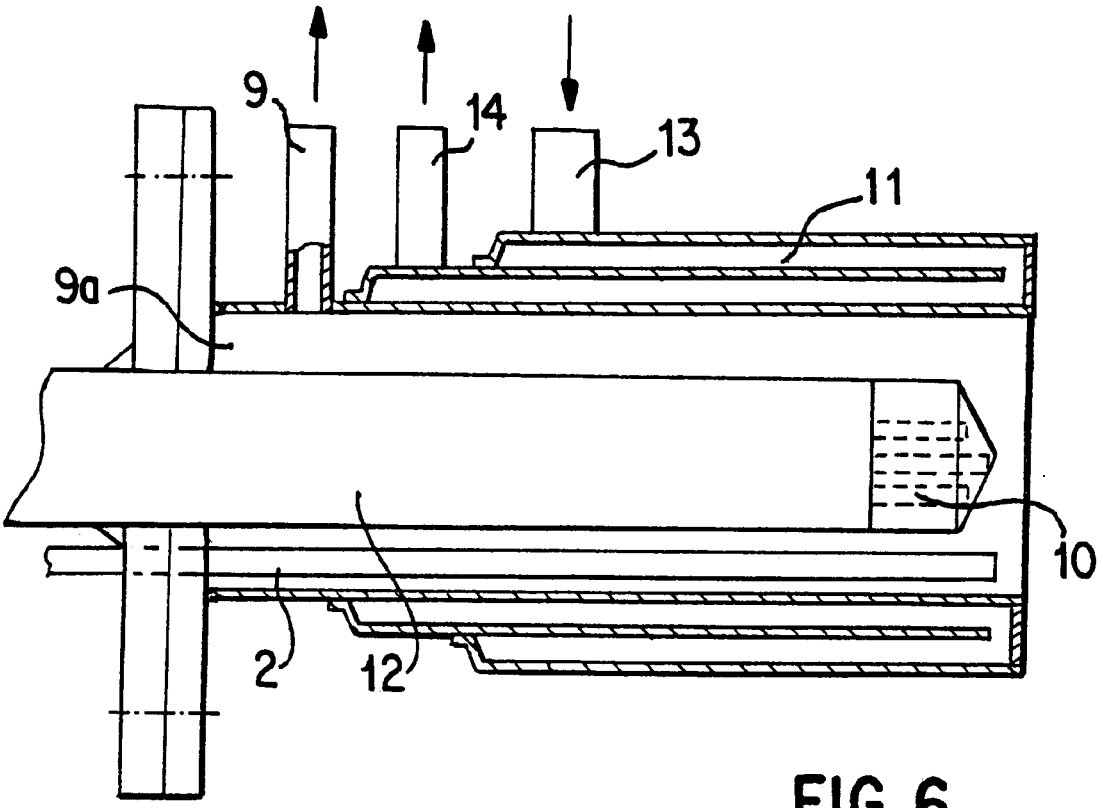
FIG. 6 is a view in lengthwise section of another embodiment of a burner with integrated lance according to the invention.
Figure 7:
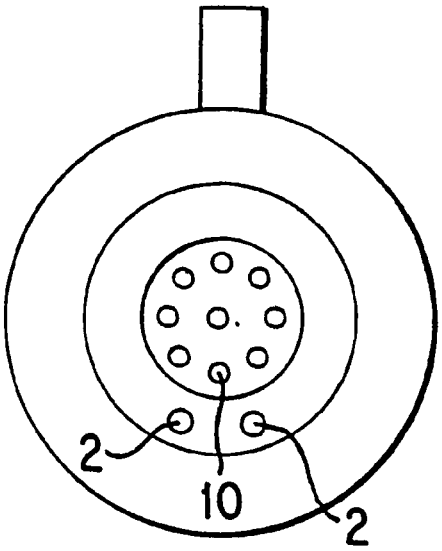
FIG. 7 is an end view of the burner of FIG. 6.

FIGS. 6 and 7 show a cooled oxygen burner comprising a peripheral jacketing 11 for circulating water, introduced at 13 and discharged at 14. As in the embodiment of FIGS. 4 and 5, the burner includes a central fuel gas delivery 12 lying in an oxygen ejection channel 9*a* and opening outwards via a series of ejectors 10, here distributed angularly and regularly. Here, at least one, in this case two oxygen lances 2 lie in the lower portion of the main oxygen channel 9*a* and open out to the exterior of the burner below the ejectors 10. In this embodiment the main oxygen in the channel 9*a*, cooled by the jacketing 11, takes part in the cooling of the oxygen lances 2.

Depending on the geography of the furnace, the oxygen lance is adjusted so as to eject the jets of oxygen in the direction towards the charge at an angle of between 5 and 25° in relation to the axis of the furnace. The flow rate of the oxygen jets ejected by the lance is chosen to be between 25 and 150% of the flow rate of oxygen in the oxygen burner.

Depending on the dimensions of the furnace, a second oxygen lance may be provided, also directed towards the charge, in the opposite end of the furnace to the burner.

The oxygen being fed, both to the lance and to the oxygen burner, is advantageously oxygen with a purity of between 88 and 95%, supplied on site by a unit for separating gas from the air using adsorption, of the type known as PSA.

Particular operating conditions will now be described. The solid fuel, in proportions of 3.2% of the steel charge, in this case approximately 5.3 tons, is anthracite, and the oxygen injected by the lance 2 is ejected at a supersonic speed at an angle of approximately 10° in relation to the axis of the furnace.

The generalized combustion of the anthracite charge is obtained approximately 10 minutes after the full power of the burner is applied, in order to redistill thus the 7% of volatile compounds which the charge contains. Subsequently, when the combined charge in the furnace reaches the proper temperature, the 86.5% of carbon in the solid charge are converted to carbon monoxide while rising towards the surface of the charge. Under the flame of the burner the oxygen ejected by the lance produces an intense combustion zone which is particularly radiant and which is virtually entirely reflected towards the charge by the screening effect provided by the flame of the burner, which thus protects the walls of the furnace.

Thus, in accordance with the objectives of the invention, a high thermal efficiency of combustion of the unburnt residues by the injected oxygen is obtained, with a consequent increase in the energy yield per unit of time throughout the duration of the process, a reduced usage of the furnace refractory and smaller losses of the metal components of the charge.

In the Tables which follow, references 1 to 18 correspond to melting processes without oxygen injection with reduced anthracite charges, references 19 to 22 using an oxygen injection directed towards a metal charge containing 1.5% of anthracite, raised to 3% in references 23 to 28.

The values shown in Tables 1 to 3 are the following:

anthracite: weight in kg per one charge of metal, time: respectively: melting/holding at temperature/total time, temperature: ° C., melting rate: ° C./minute/5.3 ton of charge total consumption: propane/oxygen, specific consumption: $m^3$/100° C./5.3 t (burner+lance), steel analysis: Ce/C/Si.

TABLE 1

| Ref. | Anthracite | Time | Temperature | Rate of melting | Total consumption |
|---|---|---|---|---|---|
| 1 | 80 | 55/41/96 | 1.361 | 14.18 | 107/536 |
| 2 | 80 | 55/37/92 | 1.367 | 14.86 | 103/514 |
| 3 | 80 | 55/55/110 | 1.321 | 12.00 | 123/614 |
| 4 | 80 | 55/42/97 | 1.370 | 14.i2 | 108/542 |
| 5 | 80 | 55/42/97 | 1.346 | 13.88 | 108/542 |
| 6 | 80 | 55/42/97 | 1.321 | 13.62 | 108/542 |
| 7 | 80 | 55/43/98 | 1.376 | 14.05 | 109/547 |
| 8 | 80 | 55/42/97 | 1.362 | 14.04 | 108/542 |
| 9 | 80 | 55/46/101 | 1.341 | 13.28 | 113/564 |
| 10 | 80 | 55/44/99 | 1.340 | 13.50 | 111/553 |
| 11 | 80 | 55/49/104 | 1.405 | 13.50 | 116/581 |
| 12 | 80 | 55/42/97 | 1.324 | 13.60 | 108/542 |
| 13 | 80 | 55/35/90 | 1.291 | 14.34 | 101/503 |
| 14 | 80 | 55/44/99 | 1.324 | 13.37 | 111/553 |
| 15 | 80 | 55/53/108 | 1.298 | 12.02 | 121/603 |
| 16 | 80 | 55/50/105 | 1.379 | 13.30 | 117/586 |
| 17 | 80 | 55/44/99 | 1.377 | 13.91 | 111/563 |
| 18 | 80 | 55/43/98 | 1.345 | 13.72 | 109/547 |
| 19 | 80 | 55/30/85 | 1.399 | 16.46 | 83/542 |
| 20 | 80 | 55/30/85 | 1.364 | 16.05 | 83/542 |
| 21 | 80 | 55/29/84 | 1.381 | 16.44 | 82/536 |
| 22 | 80 | 55/30/85 | 1.370 | 16.12 | 83/542 |
| 23 | 150 | 40/40/80 | 1.360 | 17.00 | 79/397 |
| 24 | 150 | 40/32/72 | 1.360 | 18.90 | 72/358 |
| 25 | 150 | 40/35/75 | 1.367 | 18.20 | 75/375 |
| 26 | 150 | Change | | | |
| 27 | 150 | 40/35/75 | 1.436 | 19.15 | 75/375 |
| 28 | 150 | 33/32/65 | 1.422 | 21.90 | 65/325 |
| 29 | 170 | 33/27/60 | 1.330 | 22.17 | 60/300 |

TABLE 2

| Ref. | Anthracite | Time | Temp. | Spec. consumption Propane/ oxyg. | Oxygen lance | Total oxygen |
|---|---|---|---|---|---|---|
| 1 | 80 | 55/41/96 | 1.361 | 7.88/39.38 | | |
| 2 | 80 | 55/37/92 | 1.367 | 7.50/37.60 | | |
| 3 | 80 | 55/55/110 | 1.321 | 9.30/46.48 | | |
| 4 | 80 | 55/42/97 | 1.370 | 7.90/39.56 | | |
| 5 | 80 | 55/42/97 | 1.346 | 8.05/40.27 | | |
| 6 | 80 | 55/42/97 | 1.321 | 8.20/41.03 | | |
| 7 | 80 | 55/43/98 | 1.376 | 7.95/39.75 | | |
| 8 | 80 | 55/42/97 | 1.362 | 7.95/39.75 | | |
| 9 | 80 | 55/46/101 | 1.341 | 8.41/42.06 | | |
| 10 | 80 | 55/44/99 | 1.340 | 8.25/41.27 | | |
| 11 | 80 | 55/49/104 | 1.405 | 8.26/41.35 | | |
| 12 | 80 | 55/42/97 | 1.324 | 8.18/40.94 | | |
| 13 | 80 | 5s/35/90 | 1.291 | 7.79/38.96 | | |
| 14 | 80 | 55/44/99 | 1.324 | 8.35/41.77 | | |
| 15 | 80 | 55/53/108 | 1.298 | 9.29/46.47 | | |
| 16 | 80 | 55/50/105 | 1.379 | 8.50/42.49 | | |
| 17 | 80 | 55/44/99 | 1.377 | 8.02/40.16 | | |
| 18 | 80 | 55/43/98 | 1.345 | 8.13/40.67 | | |
| 19 | 80 | 55/30/85 | 1.399 | 5.93/38.74 | | |
| 20 | 80 | 55/30/85 | 1.364 | 6.09/39.74 | | |
| 21 | 80 | 55/29/84 | 1.381 | 5.94/38.81 | | |
| 22 | 80 | 55/30/85 | 1.370 | 6.06/39.56 | | |
| 23 | 150 | 40/40/80 | 1.360 | 5.81/29.19 | 233 | 630 |
| 24 | 150 | 40/32/72 | 1.360 | 5.29/26.32 | 223 | 581 |
| 25 | 150 | 40/35/75 | 1.367 | 5.49/7.43 | 230 | 605 |
| 26 | 150 | change | | | | |
| 27 | 150 | 40/35/75 | 1.436 | 5.22/26.11 | 219 | 594 |
| 28 | 150 | 33/32/65 | 1.422 | 4.57/22.86 | 203 | 528 |
| 29 | 170 | 33/27/60 | 1.330 | 4.51/22.41 | 234 | 532 |

TABLE 3

| Ref. | Anthracite | Time | Temp. | Spec. consumption | Steel analysis |
|---|---|---|---|---|---|
| 1 | 80 | 55/41/96 | 1.361 | | |
| 2 | 80 | 55/37/92 | 1.367 | | |
| 3 | 80 | 55/55/110 | 1.321 | | |
| 4 | 80 | 55/42/97 | 1.370 | | |
| 5 | 80 | 55/42/97 | 1.346 | | |
| 6 | 80 | 55/42/97 | 1.321 | | |
| 7 | 80 | 55/43/98 | 1.376 | | |
| 8 | 80 | 55/42/97 | 1.362 | | 3.81/3.13/1.38 |
| 9 | 80 | 55/46/101 | 1.341 | | 3.59/3.09/1.18 |
| 10 | 80 | 55/44/99 | 1.340 | | 3.63/3.19/1.27 |
| 11 | 80 | 55/49/104 | 1.405 | | |
| 12 | 80 | 55/42/97 | 1.324 | | 3.64/3.09/1.88 |
| 13 | 80 | 55/35/90 | 1.291 | | 3.70/3.16/1.99 |
| 14 | 80 | 55/44/99 | 1.324 | | 3.67/3.17/1.44 |
| 15 | 80 | 55/53/108 | 1.298 | | 3.52/3.09/1.34 |
| 16 | 80 | 55/50/105 | 1.379 | | 3.62/3.04/1.68 |
| 17 | 80 | 55/44/99 | 1.377 | | |
| 18 | 80 | 55/43/98 | 1.345 | | |
| 19 | 80 | 55/30/85 | 1.399 | | |
| 20 | 80 | 55/30/85 | 1.364 | | |
| 21 | 80 | 55/29/84 | 1.381 | | |
| 22 | 80 | 55/30/85 | 1.370 | | 3.85/3.23/1.80 |
| 23 | 150 | 40/40/80 | 1.360 | 46.32 | 3.58/3.03/1.56 |
| 24 | 150 | 40/32/72 | 1.360 | 42.72 | 3.51/3.01/1.44 |
| 25 | 150 | 40/35/75 | 1.367 | 44.26 | 3.74/3.21/1.51 |
| 26 | 150 | change | | | |
| 27 | 150 | 40/35/75 | 1.436 | 41.36 | 3.71/3.17/1.55 |
| 28 | 150 | 33/32/65 | 1.422 | 37.13 | 3.58/3.06/1.51 |
| 29 | 170 | 33/27/60 | 1.330 | 40.00 | |

Figure 8:
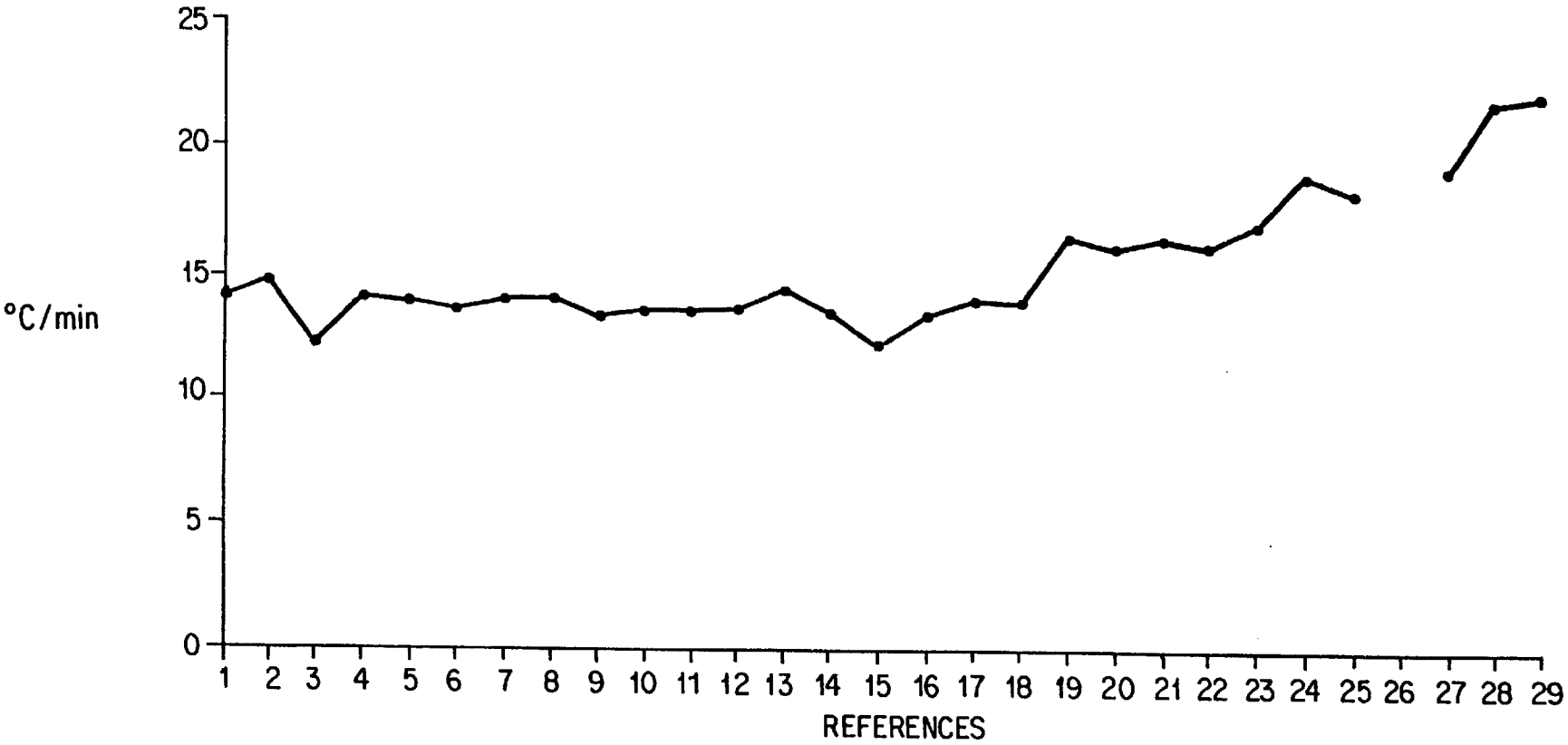
FIGS. 8 to 11 are graphs illustrating the operating parameters according to the conditions of Tables 1 to 3.

FIG. 8, which illustrates the rates of melting in ° C./minute for a 5.3 t charge for each of references 1 to 29 of the above Tables, shows that the rate changes from above 15 to more than 20 in the case of references 28 and 29, which enables the period of noncontinuous rotation of the furnace to be reduced from 55 minutes to 33 minutes and the interval between rotations from 5 to 3 minutes.

Figure 9:
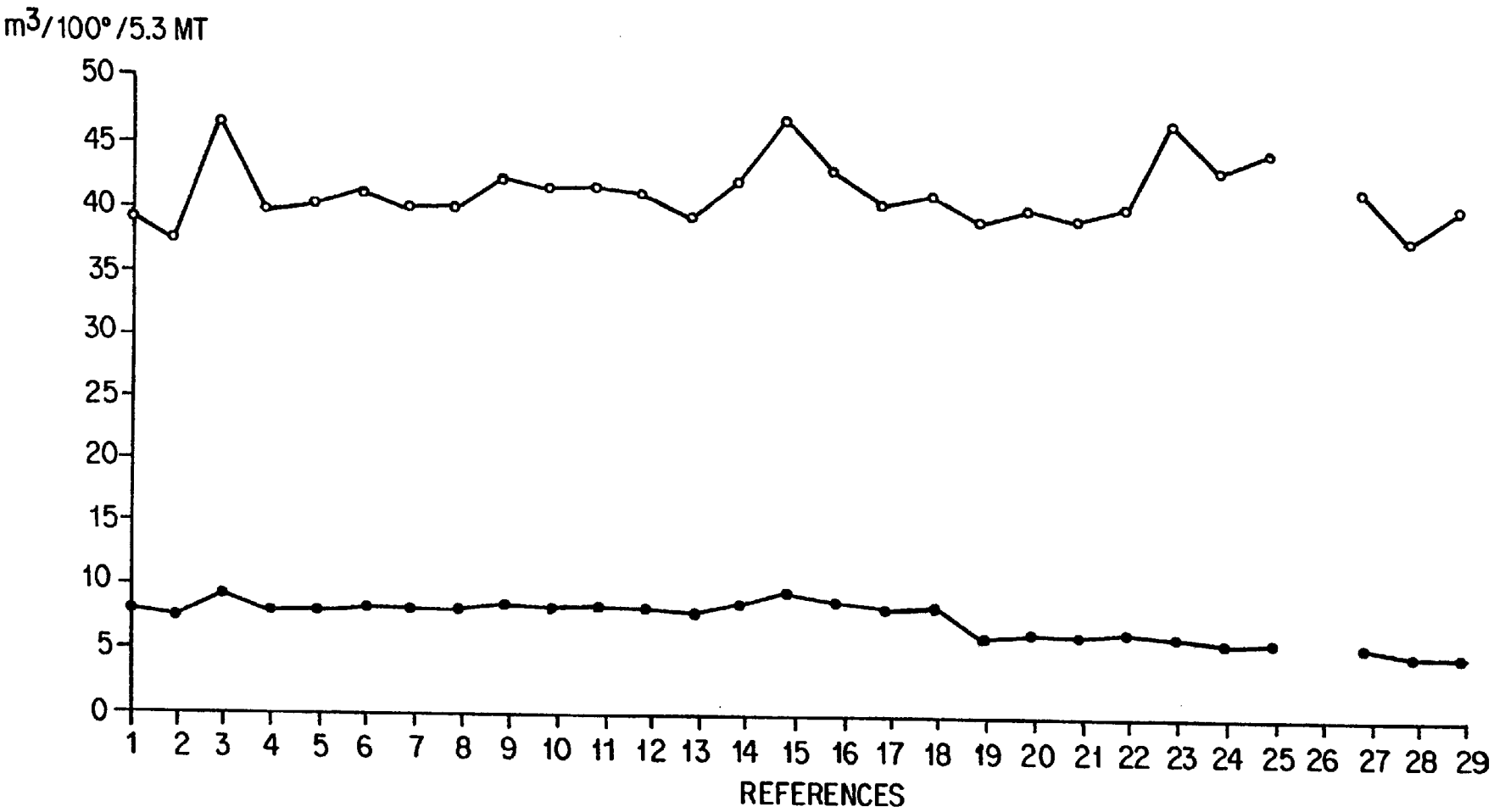

FIG. 9, which illustrates the consumption of propane (bottom curve) and of oxygen (top curve) for each of the references 1 to 29, shows that the specific consumption of propane can go down as far as 4.6 $m^3$ with an appreciably stable oxygen consumption.

Figure 10:
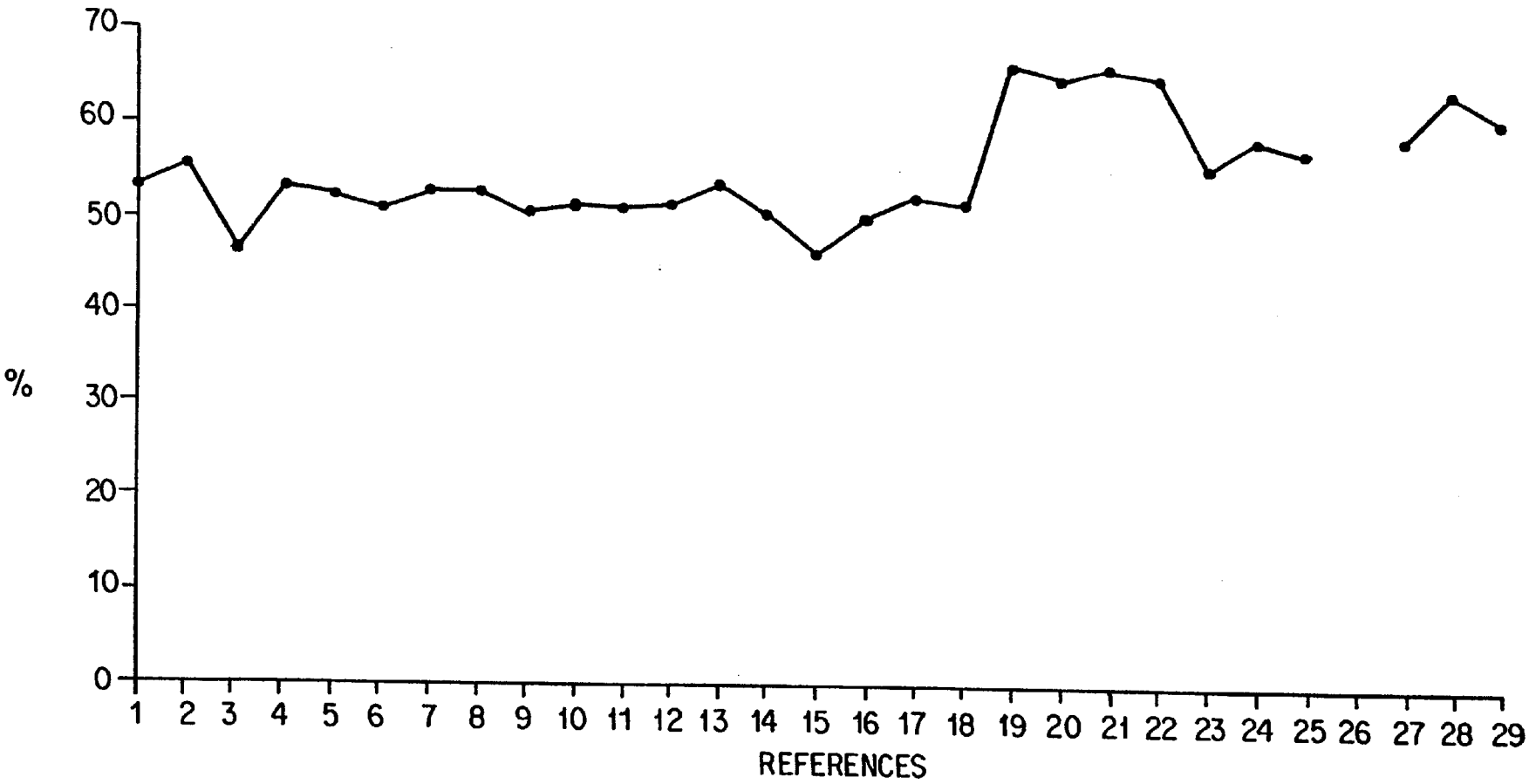

FIG. 10 shows that the efficiency of melting moves from slightly more than 50% to more than 60–65%.

Figure 11:
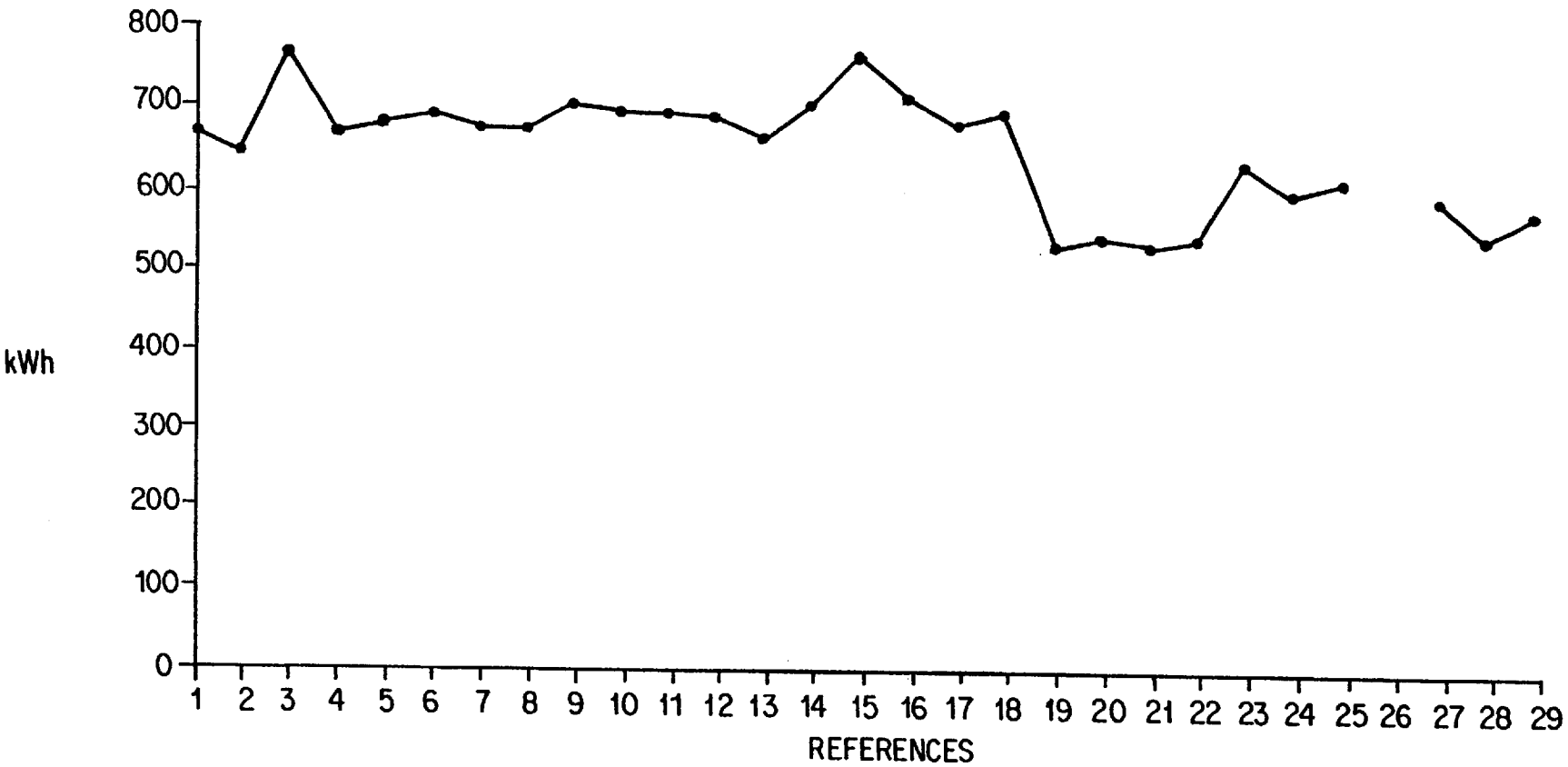

FIG. 11 shows that the energy consumption in kWh can be brought down from approximately 700 kWh to less than 600 kWh.

Figure 12:
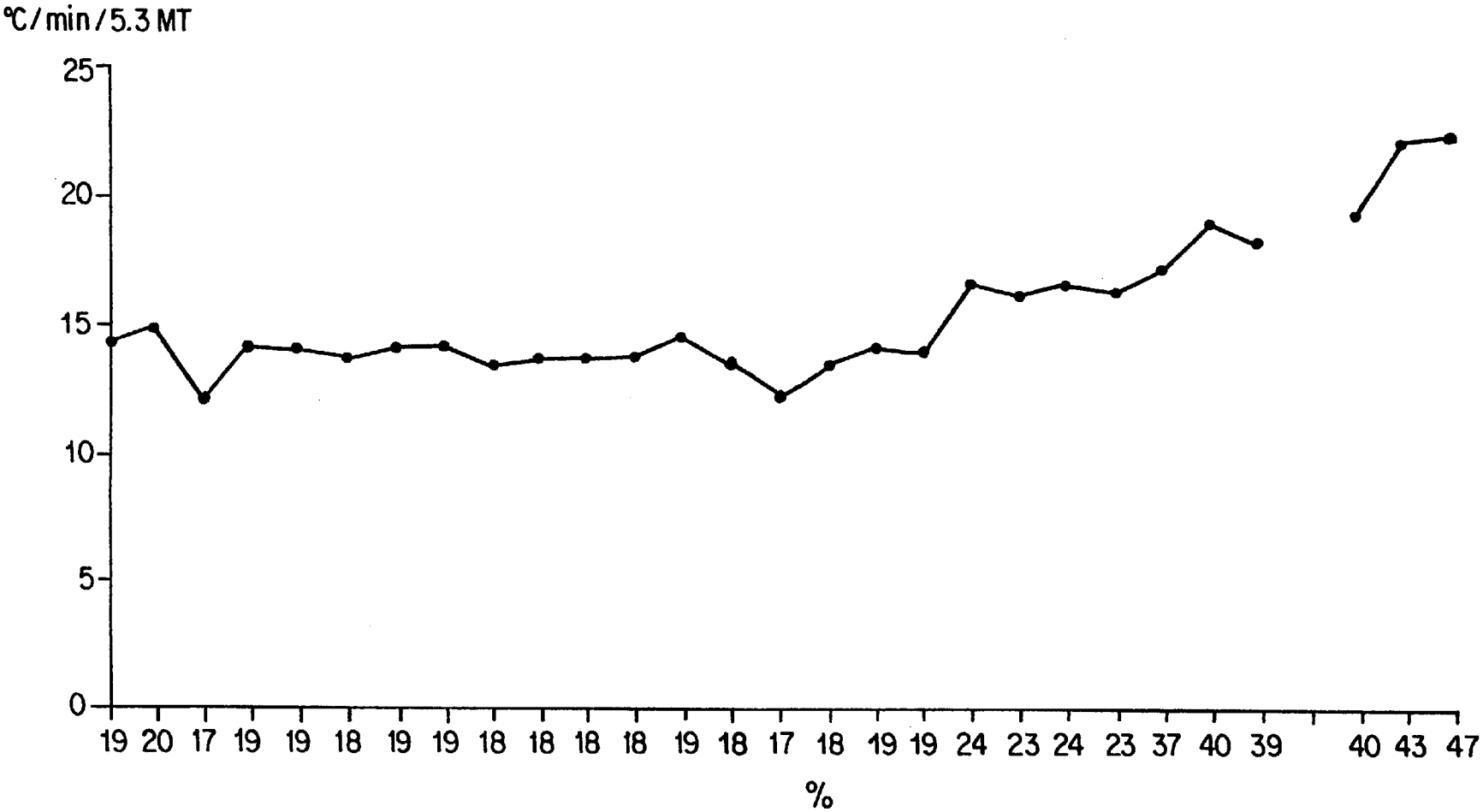
FIG. 12 is a graph illustrating the relationships between the rate of melting and the percentage of energy of combustion in the combined charge of the furnace.

FIG. 12 shows that, according to references 1 to 29, the percentage of energy in the charge changes from less than 20 to more than 40 with a corresponding increase in the rate of melting from 15 to 22° C./minute.

I claim:

1. Process for melting a metal charge in a rotary furnace equipped with at least one oxygen burner, comprising the steps of:

(i) adding between 1.5 and 9% by weight based on the metal charge of a charge of solid fuel to the metal charge to form a combined charge; and (ii) injecting at least one jet of oxygen in a direction of the combined charge in the furnace at an angle in a range from 5 to 25 degrees in relation to the axis of the furnace.

2. Process according to claim 1, wherein the charge of solid fuel in the metal charge is present in a proportion between 1.5% and 9%.

3. Process according to claim 2, wherein the charge of solid fuel in the metal charge is present in a proportion between 2 and 6%.

4. Process according to claim 1 wherein the oxygen is injected at a supersonic speed.

5. Process according to claim 1 wherein the jet of oxygen is injected between a flame of the burner and the combined charge in the furnace.

6. Process according claim 1 wherein the oxygen is injected as soon as the burner is brought into action.

7. Process according to claim 1, further comprising supplying at least the injected oxygen from a unit for separating gas from air using adsorption.

8. Rotary furnace for melting a metal charge, comprising:

(i) at least one oxygen burner at an end of the furnace; and (ii) at least one oxygen lance disposed at an angle in a range from 5 to 25 degrees in relation to the axis of the furnace to direct at least one jet of oxygen towards a bottom of the furnace.

9. Furnace according to claim 8, wherein the lance comprises at least two oxygen injection channels.

10. Furnace according to claim 8 wherein the lance is disposed below the burner.

11. Furnace according to claim 8 wherein the lance is disposed in the burner.

12. Furnace according to claim 8 wherein the burner further comprises a plurality of angularly distributed injectors.

13. Furnace according to claim 9, wherein the lance is disposed below the burner.

14. Furnace according to claim 9, wherein the lance is disposed in the burner.

15. Furnace according to claim 9, wherein the burner further comprises a plurality of angularly distributed ejectors.

16. Furnace according to claim 10, wherein the burner further comprises a plurality of angularly distributed injectors.

17. Furnace according to claim 11, wherein the burner further comprises a plurality of angularly distributed injectors.

* * * * *